US011707906B2

(12) United States Patent
Glover et al.

(10) Patent No.: US 11,707,906 B2
(45) Date of Patent: Jul. 25, 2023

(54) PREDICTIVE CONTROL OF YANKEE DRYER CHEMISTRY AND CREPED PRODUCT QUALITY

(71) Applicant: Buckman Laboratories International, Inc., Memphis, TN (US)

(72) Inventors: Daniel Glover, Brighton, TN (US); John Carter, Mobile, AL (US); Bryan Glover, Memphis, TN (US); Remi Charron, Memphis, TN (US); Mark Christopher, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 17/458,852

(22) Filed: Aug. 27, 2021

(65) Prior Publication Data

US 2022/0063229 A1 Mar. 3, 2022

Related U.S. Application Data

(60) Provisional application No. 63/071,189, filed on Aug. 27, 2020.

(51) Int. Cl.
*B31F 1/12* (2006.01)
*D21F 5/18* (2006.01)

(52) U.S. Cl.
CPC ..... *B31F 1/126* (2013.01); *D21F 5/181* (2013.01)

(58) Field of Classification Search
CPC .. B31F 1/126; B31F 1/12; D21F 5/181; D21F 5/18; D21F 11/14; D21F 5/02; D21F 7/00;

(Continued)

(56) References Cited

U.S. PATENT DOCUMENTS 4,978,861 A 12/1990 Sabater et al.
5,269,883 A 12/1993 Beuther
(Continued)

FOREIGN PATENT DOCUMENTS

EP 3647491 A1 5/2020
KR 1020140148416 A 12/2014
(Continued)

OTHER PUBLICATIONS

Arjomand, et al.: "The Investigation of Adhesion of Resins Used as Tissue Creping Adhesives for Yankee Dryer Surface Coating", J. Agri. Sci Tech. (2013) vol. 15: 793-799.
(Continued)

*Primary Examiner* — Eric Hug
*Assistant Examiner* — Matthew M Eslami
(74) *Attorney, Agent, or Firm* — Patterson Intellectual Property Law, PC

(57) ABSTRACT

A system and method is provided for proactive process intervention in manufacturing creped products via a chemical feed stage and a Yankee dryer stage. The method includes generating signals from a plurality of online sensors, corresponding to directly measured variables for respective process components such as, e.g., pH, conductivity, and Yankee blade vibration. Models are developed including retrievable information relating combinations of certain directly measured variables to respective quality characteristics of the creped product. The method further includes indirectly determining quality characteristics (e.g., softness, bulk) for the creped product, substantially in real time, based on, e.g., signals corresponding to directly measured variables, and optionally a predicted natural coating potential. An output feedback signal is automatically generated corresponding to a detected intervention event based on the indirectly determined one or more quality character-
(Continued)

istics and respective predetermined targets. The feedback signal may automatically regulate chemistry feed characteristics, substantially in real time.

18 Claims, 3 Drawing Sheets

(58) Field of Classification Search
CPC ..... D21G 9/00; D21G 9/0036; G01G 3/13; G06N 7/08; D21H 19/74; D21H 27/00
See application file for complete search history.

(56) References Cited

U.S. PATENT DOCUMENTS

| | | | |
|---|---|---|---|
| 5,512,139 | A | 4/1996 | Worcester |
| 5,571,382 | A | 11/1996 | Berglund |
| 5,635,028 | A | 6/1997 | Vinson et al. |
| 5,649,448 | A | 7/1997 | Koskimies et al. |
| 5,654,799 | A | 8/1997 | Chase et al. |
| 6,485,571 | B1 | 11/2002 | Graf |
| 6,523,401 | B2 | 2/2003 | Oechsle et al. |
| 6,701,637 | B2 | 3/2004 | Lindsay et al. |
| 6,749,723 | B2 | 6/2004 | Lindn |
| 7,101,461 | B2 | 9/2006 | Allen et al. |
| 7,545,971 | B2 | 6/2009 | Shakespeare |
| 7,803,899 | B2 | 9/2010 | Zollinger et al. |
| 7,959,763 | B2 | 6/2011 | Machattie et al. |
| 8,308,900 | B2 | 11/2012 | Covarrubias et al. |
| 8,568,562 | B2 | 10/2013 | Sullivan et al. |
| 8,691,323 | B2 | 4/2014 | Von Drasek et al. |
| 8,958,898 | B2 | 2/2015 | Von Drasek et al. |
| 9,109,330 | B2 | 8/2015 | Shakespeare et al. |
| 9,121,136 | B2 | 9/2015 | Aengeneyndt et al. |
| 9,182,271 | B2 | 11/2015 | Grigoriev et al. |
| 9,238,889 | B2 | 1/2016 | Paavola et al. |
| 9,266,301 | B2 | 2/2016 | Furman et al. |
| 9,303,977 | B2 | 4/2016 | Kellomki et al. |
| 9,388,530 | B2 | 7/2016 | Von Drasek et al. |
| 9,404,895 | B2 | 8/2016 | Von Drasek et al. |
| 9,721,377 | B2 | 8/2017 | Raunio et al. |
| 9,851,199 | B2 | 12/2017 | Von Drasek et al. |
| 10,043,256 | B2 | 8/2018 | Toskala et al. |
| 10,329,715 | B2 | 6/2019 | Buist et al. |
| 10,496,061 | B2 | 12/2019 | Strohmenger et al. |
| 10,501,274 | B2 | 12/2019 | Ramakrishnan et al. |
| 10,604,896 | B2 | 3/2020 | Von Drasek et al. |
| 10,643,323 | B2 | 5/2020 | Toskala et al. |
| 10,697,119 | B2 | 6/2020 | Kallerdahl et al. |
| 10,844,547 | B2 | 11/2020 | Silva et al. |
| 10,914,037 | B2 | 2/2021 | Gorden |
| 10,941,522 | B1 | 3/2021 | Buist et al. |
| 11,015,293 | B2 | 5/2021 | Patterson |
| 11,041,271 | B2 | 6/2021 | Luneau et al. |
| 2002/0060017 | A1 | 5/2002 | Kuusisto et al. |
| 2006/0143671 | A1 | 6/2006 | Ens et al. |
| 2007/0204966 | A1 | 9/2007 | Chou et al. |
| 2010/0086672 | A1 | 4/2010 | Von Drasek et al. |
| 2010/0269996 | A1 | 10/2010 | Grattan et al. |
| 2011/0297341 | A1 | 12/2011 | Dilkus |
| 2012/0211190 | A1 | 8/2012 | Goto et al. |
| 2013/0048238 | A1 | 2/2013 | Glover et al. |
| 2013/0180677 | A1 | 7/2013 | Thomas et al. |
| 2013/0245158 | A1 | 9/2013 | Grigoriev et al. |
| 2014/0096925 | A1 | 4/2014 | Gorden |
| 2014/0110071 | A1 | 4/2014 | Furman et al. |
| 2014/0254885 | A1 | 9/2014 | Sze |
| 2015/0053358 | A1 | 2/2015 | Ban et al. |
| 2015/0159329 | A1 | 6/2015 | Tan et al. |
| 2015/0299952 | A1 | 10/2015 | Kalaniemi |
| 2016/0032527 | A1 | 2/2016 | Gorden |
| 2016/0340830 | A1* | 11/2016 | Von Drasek ..... D21G 3/00 |
| 2017/0016181 | A1 | 1/2017 | Edbauer et al. |
| 2017/0357240 | A1 | 12/2017 | Stewart et al. |
| 2019/0024316 | A1* | 1/2019 | Buist ..... B05D 1/002 |
| 2020/0277734 | A1 | 9/2020 | Kallerdahl et al. |

FOREIGN PATENT DOCUMENTS

| | | | |
|---|---|---|---|
| WO | 2013037926 | A1 | 3/2013 |
| WO | 2019016749 | A1 | 1/2019 |
| WO | 2021137133 | A1 | 7/2021 |

OTHER PUBLICATIONS

Boudreau: "New methods for evaluation of tissue creping an dthe importance of coating, paper and adesion", urn: nbn:se:kau:diva-29317, ISBN 978-91-7063-525-0, ISSN 1403-8099, Dissertation, Karlstad University Studies, 2013:47.

Chu et al.: "Multivariable Controland Energy Optimization of Tissue Machines," Pulp & Paper Canada; Nov./Dec. 2010; 111, 6; Agricultural &Enviromental Science Collection, 5 pages.

Furman, et al.: "World Class Yankee Coatings—Combining the Latest Chemistry and Monitoring Techniques", UBM Asia Trade Fairs Pte Ltd. presented at Tissue World 2011, Mar. 28-31, 2011, Nice, France, 12 pages.

Padley, Ian: "Advanced Yankee Surface Management", Tissue 2017 Conference & Expo, 32 pages.

TECHPAP SAS: "TSSA—optical online analysis system for tissue paper microcreping—User's manual, Concerning software reelase 3.05.00", Time Stamp: May 2019, 18 pages.

Search Report and Written Opinion of International application No. PCT/US2021/047920, dated Dec. 20, 2021, 11 pages.

* cited by examiner

PREDICTIVE CONTROL OF YANKEE DRYER CHEMISTRY AND CREPED PRODUCT QUALITY

CROSS-REFERENCES TO RELATED APPLICATIONS

This application claims benefit of the following patent application which is hereby incorporated by reference: U.S. Provisional Patent Application No. 63/071,189 filed Aug. 27, 2020.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to predictive systems and methods for use in creped product manufacturing processes. More particularly, embodiments of inventions as disclosed herein relate to systems and methods to proactively alert users or implement automated interventions in creped product manufacturing processes via data analytics.

Conventional processes for the manufacture of creped products such as bath tissue, paper towels and napkins are well-established and require little elaboration herein. Generally stated, a continuous wet fibrous sheet is generated from a pulp stock having characteristics defined in part by the particular combination of one or more constituent fiber sources, and further in view of chemical additives, water source and the like. A heated rotary drying cylinder (an example of which is herein referred to as a "Yankee dryer") is configured to pick up the wet sheet, to substantially dry the sheet, and then crepe the sheet in combination with a creping doctor blade associated therewith. This creping process imparts a three-dimensional structure to the sheet that is responsible, e.g., for the soft feel of tissue products. Creped products can be made using (but not limited to) light dry crepe machines, wet crepe machines, as well as through air drying (TAD) and other machines that may impart a structure to the sheet prior to the Yankee dryer.

The creping process, and more particularly the surface conditions on the Yankee dryer, are critical factors in the overall manufacturing process. For the sheet to attach to the Yankee dryer surface there must be a thin adhesive coating present. This adhesive coating will in fact aid in the pickup of the sheet. The strength of the adhesive force between the Yankee dryer surface and the sheet is very important factor in tissue manufacture. The force must be strong enough to hold the sheet in place, but weak enough to release the sheet at the proper point. Specifically designed chemical formulations are applied to the Yankee dryer surface to provide the necessary adhesion and release properties of the surface. The pulp stock that provides the material that forms the web fibrous sheet also includes substances that will stick to the Yankee dryer surface and provide an adhesive force. The term "natural coating" may be used for this material that naturally comes from the stock and coats the surface of the Yankee dryer. The composition of the pulp stock changes as the fiber sources or additives in that stock change, or as the characteristics of the water change. This variation requires adjustment in the amount of the chemical formulations that are used to control the adhesion and release properties of the Yankee dryer surface. The "natural coating" plus the chemical additive together provides the total adhesive force.

Conventional techniques for adjusting the adhesive coating feed rate to achieve proper characteristics on the Yankee dryer are labor- and time-intensive, and further rely on assumptions regarding machine operation. As one example of a known process flow, the user is prompted to adjust the coating feed rate based on a fiber source (furnish) change, such as for example in view of a change in tissue grade. A mill employee or chemical supplier sales representative may, perhaps within minutes of the furnish change, obtain and begin testing of a sample to determine characteristics such as the total suspended solids (TSS) therein. This process is not online and therefore is not instantaneous or otherwise conducted in real time. The user can then inspect the set points for stock flow and machine speed, via for example a machine control system, for the given creped product grade and calculate the natural coating potential using a predetermined equation. However, this requires the assumption that the machine is operating at the stated set points.

Understanding and monitoring the amount of natural coating is an important part of improving Yankee dryer adhesive performance, which leads to better production of creped products. It would therefore be desirable to measure relevant online process characteristics and subsequently predict the amount of natural coating available to transfer to the coating, substantially in real time or at any given selected time. However, the inherently dynamic nature of the creped product manufacturing process has traditionally made such predictive analysis and corrections extremely difficult and impractical.

Of particular relevance to the present disclosure is the variability of crepe structure, and thus the variation in sheet qualities such as softness, bulk, bulk to basis weight, and the like. As previously noted, most if not all quality measurements are currently only performed after a reel is made, and therefore many tons of tissue can be wasted while waiting for a reel to finish. Currently there is no efficient way to predict all these properties in real time.

It would therefore be desirable to utilize available measurements that can be directly captured online and continuously determine, indirectly but substantially in real time, one or more of the tissue quality characteristics referenced above.

It would further be desirable to generate feedback based on intervention events corresponding to such indirectly determined tissue quality characteristics, for example to automatically regulate chemistry feed skids for proactive correction if the predicted characteristics do not match predetermined targets.

BRIEF SUMMARY

In view of some or all of the aforementioned issues and objectives, systems and methods as disclosed herein may implement algorithms based on various directly measurable variables for real time indirect estimation or prediction of creped product quality, and associated feedback for control purposes. Such algorithms may for example be dynamic in nature based on observed correlations over time between various combinations of process inputs and desired outcomes in the form of creped product quality aspects. Inputs to the algorithm may include for example a natural coating potential, tangential and perpendicular vibration monitoring, pH, temperature, conductivity, and other measurements as may be needed to verify control of the creping chemistry and/or potentially to adjust pH as needed for more or less reactivity. Each system output may be provided to a display unit for user viewing, and certain algorithms may also guide the adjustments to process components such as Yankee dryer chemistry in either manual or automatic control modes. A user interface may be provided to enable user entry of specific and acceptable thresholds or ranges for crepe quality, for example in the context of blade vibration characteristics and the like.

Various sensors, controllers, online devices, and other intermediate components may be "Internet-of-things" (IoT) compatible, or otherwise comprise an interrelated network, wherein relevant outputs may be uploaded to a cloud-based server in real time. This data may further be made available to creped product manufacturers along with tools for, e.g., online analytical processing, graphing historical data for trends, etc. In some cases, the system may be linked to communicate with an industrial plant's local control system to improve overall diagnosis of quality issues, wherein quality data collected manually may be compared with the real time data and also compared to the monitored or determined process components such as vibration data, etc.

One particular embodiment of a method as disclosed herein is provided for proactive process intervention in an industrial facility manufacturing creped products via a chemical feed stage and a Yankee dryer stage. Generally stated, the chemical feed stage may comprise a stock with one or more fiber sources from which a fibrous sheet is generated and transferred to engage a surface of the Yankee dryer, and the Yankee dryer stage may comprise an adhesive coating application unit and at least one blade configured to disengage the fibrous sheet from the surface of the Yankee dryer. In relevant part, the method includes generating signals from a plurality of online sensors, the signals corresponding to directly measured variables for respective process components, selectively retrieving information from models relating combinations of at least the directly measured variables to respective quality characteristics of at least the manufactured creped product, and indirectly determining one or more quality characteristics in the manufactured creped product, substantially in real time, based at least on one or more of the signals corresponding to directly measured variables. An output feedback signal may further be automatically generated as corresponding to a detected intervention event based on the indirectly determined one or more quality characteristics and respective predetermined targets.

In an exemplary aspect of the above-referenced embodiment, a first value may be generated for total suspended solids associated with the stock flow based on a first predetermined correlation with one or more directly measured variables, and a second value may be generated for total dissolved solids associated with the stock flow based on a second predetermined correlation with one or more directly measured variables. A natural coating potential to be applied from the fibrous sheet to the surface of the Yankee dryer may then be predicted, substantially in real time, based at least in part on the generated values for total suspended solids and total dissolved solids, wherein the indirectly determined one or more quality characteristics are further based at least on the predicted natural coating potential to be applied from the fibrous sheet to the Yankee dryer.

In another exemplary aspect of the above-referenced embodiment, an optimal adhesive coating feed rate is determined for projection upon the surface of the Yankee dryer, based at least in part on the predicted natural coating potential, and one or more feedback signals are generated to the adhesive coating application unit to automatically regulate the adhesive coating feed rate based on a comparison of the determined optimal value with an actual adhesive coating feed rate.

In another exemplary aspect of the above-referenced embodiment, the directly measured variables for respective process components comprise directly measured vibrations of the dryer blade, and the indirectly determined one or more quality characteristics are further based at least on the vibrations of the dryer blade.

In another exemplary aspect of the above-referenced embodiment, the directly measured vibrations of the blade may comprise measured tangential and perpendicular vibrations of the blade.

In another exemplary aspect of the above-referenced embodiment, the indirectly determined one or more quality characteristics may comprise one or more of: a softness of the manufactured creped product; a crepe count per unit for the manufactured creped product; and a bulk to basis weight for the manufactured creped product.

In another exemplary aspect of the above-referenced embodiment, the detected intervention event may be based on a threshold or range violation by at least one of the indirectly determined one or more quality characteristics.

In another exemplary aspect of the above-referenced embodiment, the detected intervention event may be based on a non-threshold violation with respect to a target control value for at least one of the indirectly determined one or more quality characteristics.

In another exemplary aspect of the above-referenced embodiment, the output feedback signal may be provided for automatic control of one or more actuators in the chemical feed stage for respective process components relating to the detected intervention event.

In another exemplary aspect of the above-referenced embodiment, the output feedback signal may be provided to a display unit, upon which is generated a prompt corresponding to the detected intervention event.

It may be appreciated that various ones of the above-referenced aspects may be provided individually or otherwise in combination with respect to the above-referenced embodiment.

In another embodiment, a system is disclosed herein for proactive process intervention in an industrial facility manufacturing creped products via a chemical feed stage and a Yankee dryer stage, wherein the chemical feed stage comprises a stock with one or more fiber sources from which a fibrous sheet is generated and transferred to engage a surface of the Yankee dryer, and wherein the Yankee dryer stage comprises an adhesive coating application unit and at least one blade configured to disengage the fibrous sheet from the surface of the Yankee dryer. The system includes a plurality of online sensors, each of the online sensors configured to produce signals corresponding to directly measured variables for respective process components. One or more communications devices may be functionally linked to the plurality of online sensors and configured to generate messages to a remote server via a communications network, wherein the generated messages comprise data corresponding to the directly measured variables for each of the respective components. The remote server may comprise or be functionally linked to a data storage further comprising models relating combinations of at least the directly measured variables to respective quality characteristics of at least the manufactured creped product. The server is further configured to automatically direct the performance of steps at least according to the above-referenced method embodiment and any one or more of the above-referenced aspects.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
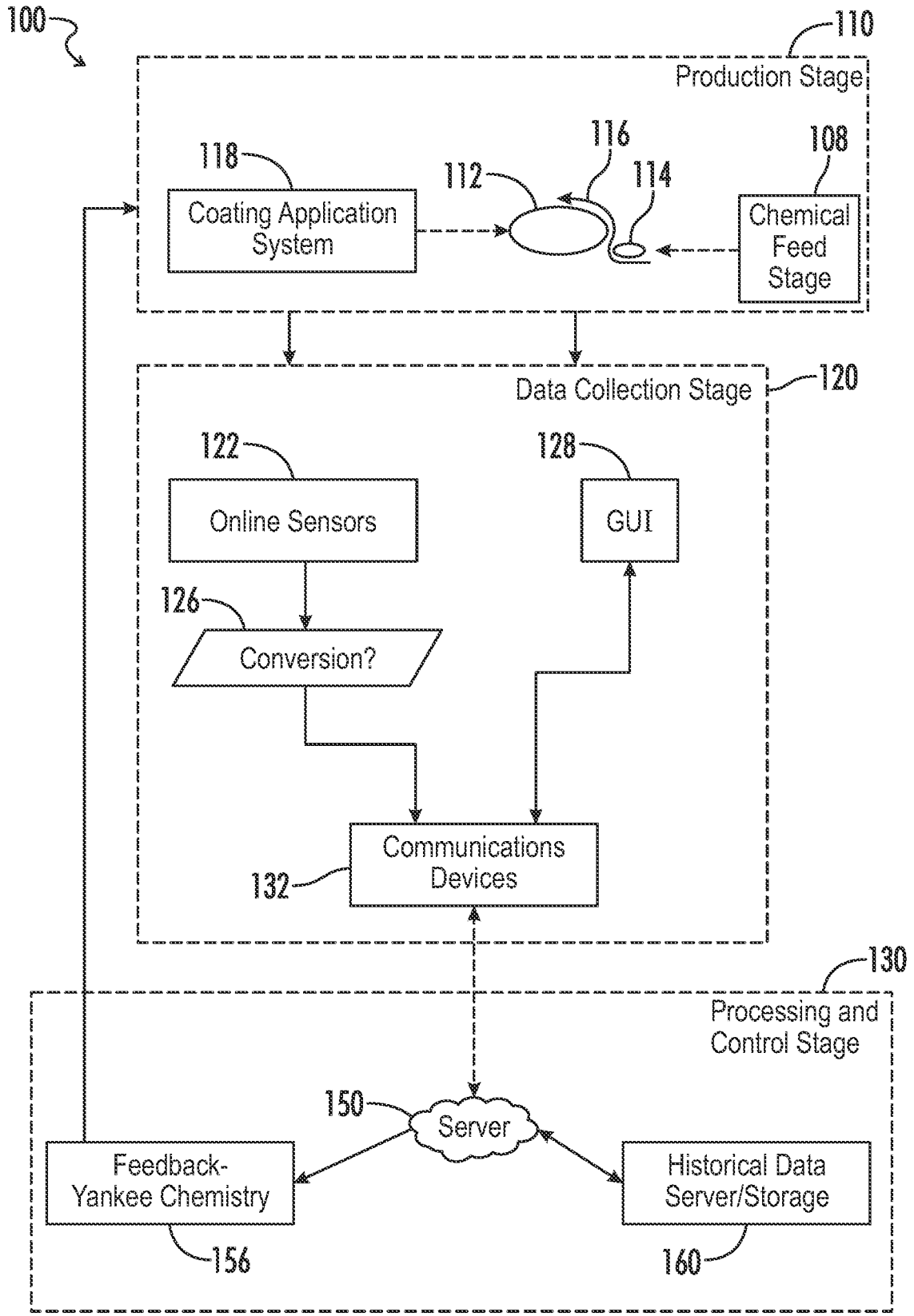
FIG. 1 is a block diagram representing an exemplary embodiment of a system as disclosed herein.
Figure 2:
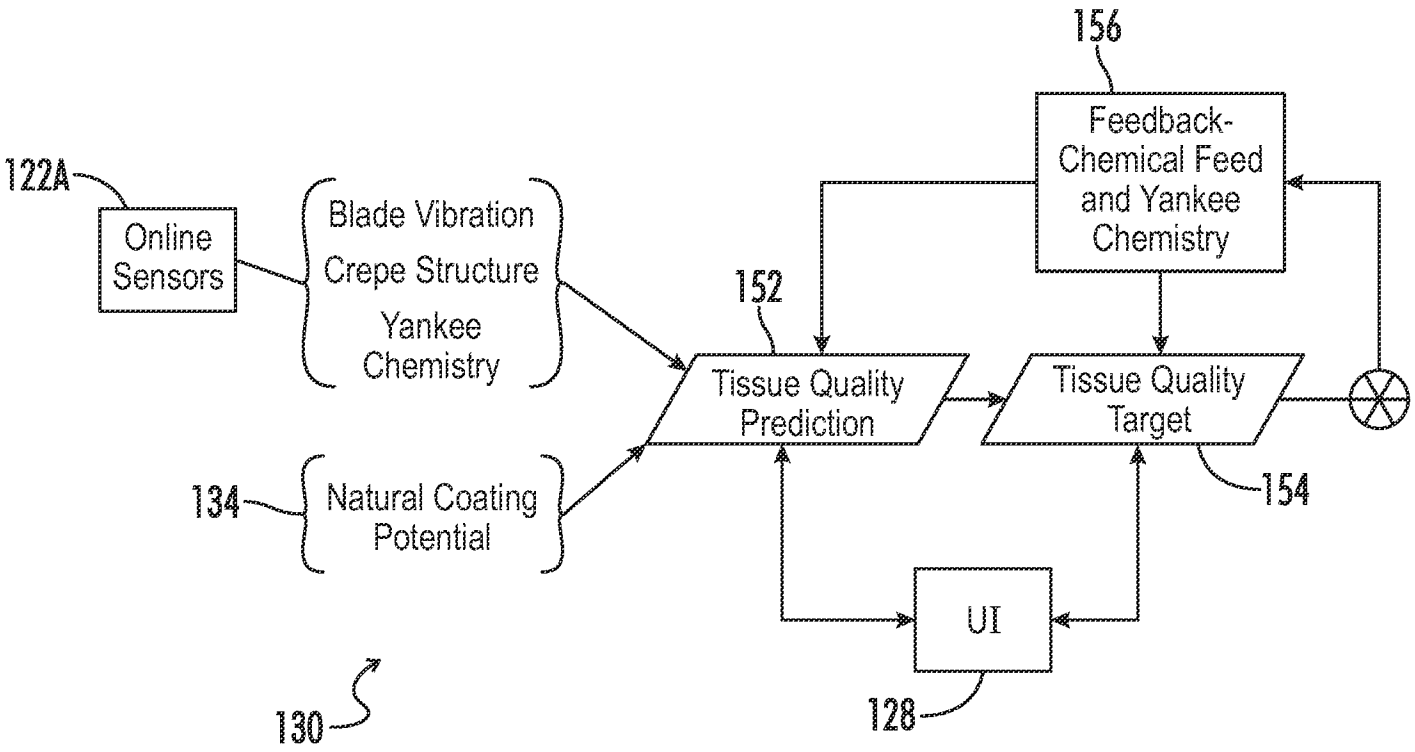
FIG. 2 is a diagram and simplified flowchart representing an exemplary embodiment of a method as disclosed herein.
Figure 3:
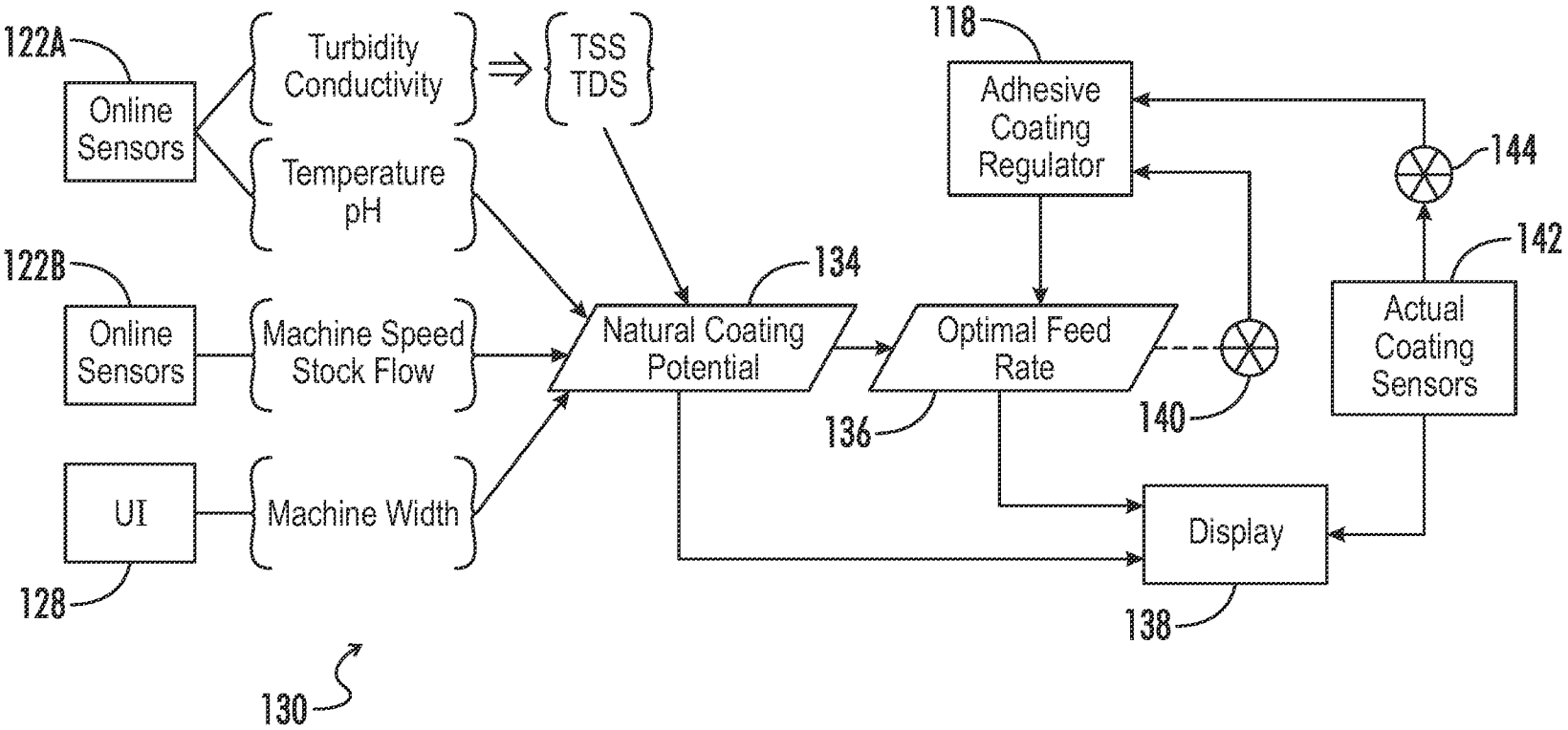
FIG. 3 is a diagram and simplified flowchart representing an optional sub-process according to the embodiment of FIG. 2.

Referring generally to FIGS. 1-3, various exemplary embodiments of an invention may now be described in detail. Where the various figures may describe embodiments sharing various common elements and features with other embodiments, similar elements and features are given the same reference numerals and redundant description thereof may be omitted below.

Briefly stated, systems and methods as disclosed herein may be implemented to allow for the continuous, real-time monitoring of the creping chemistry applied on a Yankee dryer and its impact on quality, and further control of the chemical feed skids to correct for various conditions automatically. By measuring or indirectly determining variables such as, e.g., the natural coating, the blade vibration, and the crepe structure in real time and continuously, feedback loops can be used, e.g., in machine learning mode to automatically adjust chemical feed to correct quality issues before the reel is capable of being actually tested by tissue machine operators.

Referring first to FIG. 1, an embodiment of a monitoring and control system 100 as disclosed herein may be provided with respect to a creped product manufacturing system and process. The term "creped product" as used herein may generally refer to a fibrous sheet material, which may include additional materials. Associated fibers may be synthetic, natural or combinations thereof. The "creped product manufacturing process" as referred to herein may generally include at least the formation of an aqueous slurry comprising the associated fibers, dewatering the slurry to form a continuous fibrous sheet, applying the sheet to the Yankee dryer surface for the purpose of drying the fibrous sheet, and regulating a quantity and quality of adhesive and release aids applied to the surface of the Yankee dryer.

A creped product production stage 110 including a chemical feed stage 108 as represented in FIG. 1 is substantially as conventionally known, and detailed description is unnecessary here for those of skill in the art. A Yankee dryer 112 is configured in proximal association with one or more pressure rolls 114 to direct the continuous wet fibrous sheet 116 across the surface of the Yankee dryer 112 and remove as much water as possible from the sheet. A creping blade and a reel (not shown) may further be configured to engage the sheet 116, such as on an opposing end of the Yankee dryer 112 with respect to the pressure roll 114.

The term "industrial plant" as used herein may generally connote a facility for production of creped products such as, e.g., bath tissue, paper towels, napkins, and the like, independently or as part of a group of such facilities.

A system "host" as referred to herein may generally be independent of a given industrial plant, but this aspect is not necessary within the scope of the present disclosure. A system host may be directly associated with an embodiment of the cloud-based server system 100 and capable of directly or indirectly implementing predictive analysis and control operations as disclosed herein for each of a group of industrial plants.

A coating application system 118 is provided to project a synthetic adhesive coating across the surface of the Yankee dryer 112. The adhesive coating may include any of various components and combinations thereof, as are well known in the art, but may generally be characterized as including at least an adhesive aid portion for causing the sheet to properly adhere to the surface of the Yankee dryer 112, and a release aid portion for causing the sheet 116 to properly release from the surface of the Yankee dryer 112 upon engagement by the creping blade. The coating application system 118 may generally include one or more chemical additives provided in determined relative quantities into a mixing tank, and fed from the tank to an array of spray nozzles transversely oriented with respect to a diameter of the Yankee dryer 112, and substantially across a width of the Yankee dryer 112 so as to preferably provide a relatively uniform coating. In an embodiment, the adhesive aid portion and the release aid portion may preferably be mixed together prior to application in a Yankee dryer coating as referred to herein. In an alternative embodiment, various constituent components of the overall adhesive coating may be independently sprayed onto the surface of the Yankee dryer 112. An initial target flow rate of the adhesive coating may be determined based on various variables including, but not necessarily limited to, a nozzle spacing, distance of the nozzles from the Yankee dryer surface, spray angle, and the like.

A control system as disclosed herein may optionally be configured to predictively measure and analyze a natural coating associated with the stock/fibrous sheet to determine the direct influence in real time of wet end chemistries and the furnish type with its level of refining, water hardness, level of ash, etc. This natural coating will impact Yankee dryer coating characteristics such as hardness, and thus the level of protection of the Yankee dryer 112. For example, one of skill in the art may appreciate that when the Yankee dryer coating gets too hard, this can lead to a phenomenon referred to as "stick and slip," which can result in chatter events. Therefore, one object of a system and method as disclosed herein may be to provide online information to proactively manage the level of adhesive and ensure that the creping blade rides in the synthetic coating (and not on the metal surface of the Yankee dryer 112). An exemplary and non-limiting list of benefits of the online natural coating include: chatter prevention; better creping blade life and reduction of creping blade wear; optimal sheet transfer and quality; softness of the end product; felt filling prevention; and crepe efficiency (reel speed). Accordingly, another potential object of a system and method as disclosed herein may be to provide online information to proactively advise or prompt users to change creping blades, based on detected intervention events corresponding to creping blade wear or the like.

A data collection stage 120 may include a plurality of sensors 122 positioned online with various respective components of the production stage 110, such as for example the chemical feed stage 108, the Yankee dryer 112, the creping blade, the creped product itself, the coating application unit 118, etc. Some or all of the sensors 122 may preferably be configured to, substantially continuously, generate signals corresponding to real-time values for conditions and/or states of the respective components. The sensors may be configured to calibrate or otherwise transform raw measurement signals into output data in a form or protocol to be processed by downstream computing devices, or in various embodiments one or more intervening computing devices 126 may be implemented to receive raw signals from some or all of the sensors and provide any requisite calibration or transformation into a desired output data format.

The term "sensors" may include, without limitation, physical level sensors, relays, and equivalent monitoring devices as may be provided to directly measure values or variables for associated process components or elements, or to measure appropriate derivative values from which the process components or elements may be measured or calculated.

The term "online" as used herein may generally refer to the use of a device, sensor, or corresponding elements proximally located to a container, machine, or associated process elements, and generating output signals substantially in real time corresponding to the desired process elements, as distinguished from manual or automated sample collection and "offline" analysis in a laboratory or through visual observation by one or more operators.

In the context of the creping blade, at least two sensors 122 may for example be perpendicularly mounted and configured to generate signals corresponding to blade vibration. The resulting blade vibration data can be influenced by, e.g., a configuration and/or condition of the blade, friction between the blade and the coating surface, back vibrations, mechanical characteristics of the blade/coating/Yankee dryer 112 surface, and the like. Monitoring behavior of the blade via vibration data from the plurality of sensors 122 may yield improved understanding of blade lifetime optimization and usage optimization (e.g., with respect to load, angle, run time, etc.), the different behaviors of respective blade configurations, methods for reducing friction and/or Yankee dryer 112 edge deposits, and the like. In one embodiment, the two aforementioned perpendicularly mounted sensors 122 may generate corresponding directional signals (for example, tangential force data in a first direction and perpendicular force data in a second direction), wherein a resultant value may be determined therefrom. The resultant value may be compared with a threshold value or range, such as for example a maximum value, corresponding to an intervention event wherein a change of the creping blade is recommended for maintaining quality of the creped product and/or the creped product manufacturing process more generally.

Online sensors 122 are well known in the art for the purpose of sensing or calculating characteristics such as turbidity, conductivity, pH and the like, and exemplary such sensors 122 are considered as being fully compatible with the scope of a system and method as disclosed herein. Online sensors 122 are also known in the art for the purpose of sensing or determining blade vibration, tangential and/or perpendicular with respect to the surface of the Yankee dryer, and exemplary such sensors 122 are also considered as being fully compatible with the scope of a system and method as disclosed herein.

Individual sensors 122 may be separately mounted and configured, or the system 100 may provide a modular housing which includes, e.g., a plurality of sensors or sensing elements 122. Sensors or sensor elements 122 may be mounted permanently or portably in a particular location respective to the production stage 110, or may be dynamically adjustable in position so as to collect data from a plurality of locations during operation.

Online sensors 122 as disclosed herein may provide substantially continuous measurements with respect to various process components and elements, and substantially in real-time. The terms "continuous" and "real-time" as used herein, at least with respect to the disclosed sensor outputs, does not require an explicit degree of continuity, but rather may generally describe a series of measurements corresponding to physical and technological capabilities of the sensors 122, the physical and technological capabilities of the transmission media, the physical and technological capabilities of any intervening local controller, communications device, and/or interface configured to receive the sensor output signals, etc. For example, measurements may be taken and provided periodically and at a rate slower than the maximum possible rate based on the relevant hardware components, or based on a communications network configuration which smooths out input values over time, and still be considered "continuous."

One or more additional online sensors 122 may be configured to provide substantially continuous measurements with respect to machine operating parameters. A graphical user interface (GUI) 128 may be further provided and configured to enable operator input regarding additional parameters and/or coefficients as further described below. The user interface 128 may further enable users such as operators, administrators, and the like to provide periodic input with respect to conditions or states of additional components of relevance to the downstream algorithms as further discussed herein. The user interface 128 may be in functional communication with a hosted server 150 and/or local process control units (not shown), directly or for example via local communications devices 132 as further described below, to receive and display process-related information, or to provide other forms of feedback with respect to, e.g., control processes as further discussed herein. The term "user interface" 128 as used herein may unless otherwise stated include any input-output module with respect to a controller 130 and/or a hosted data server 150, including but not limited to: a stationary operator panel with keyed data entry, touch screen, buttons, dials, or the like; web portals, such as individual web pages or those collectively defining a hosted website; mobile device applications, and the like. As further described below, the term "controller" is used herein to refer to a local controller or more generally to a processing and control stage 130 which may include the hosted data server 150, but it is noted that unless otherwise stated for a given embodiment the process control functions may be implemented via a local or external computing device/network without limitation.

Accordingly, one example of the user interface 128 may be as generated remotely on a user computing device and communicatively linked to the remote server 150. Alternatively, an example of the user interface 128 may within the scope of the present disclosure be generated on a stationary display unit in an operator control panel (not shown) associated with a production stage 110 of an industrial plant.

The data collection stage 120 may further include one or more communications devices 132 configured to receive output signals from the online sensors 122 and to transmit corresponding output data to a hosted server 150 via, e.g., a communications network. A communications device 132 may be stand-alone or alternatively be comprised of a local controller (not shown) configured for example to direct the collection and transmittal of data from the industrial plant to the cloud server 150, and further to direct output signals from the server 150 to other process controllers at the plant level or more directly to process actuators in the form of control signals to implement automated interventions. In some embodiments the communications device 132 or local controller may be omitted, where for example data collection tools are distributed to directly transmit data streams via the communications network, and a user computing device which also displays and implements the GUI 128 is implemented to receive the output signals from the server 150, etc. In some embodiments, the communications device 132 or local controller may be comprised of at least part of an industrial plant's resident control system.

In an embodiment, a conversion stage 126 may be added for the purpose of converting raw signals from one or more of the online sensors 122 to a signal compatible with data transmission or data processing protocols of the communications network and/or cloud server-based storage and applications. A conversion stage 126 may relate not only to input requirements but also may further be provided for data security between one or more sensors 122 and the cloud-based server 150, or between local communications devices such as a local controller and the server 150. The conversion stage 126 may further convert raw signals from one or more of the online sensors 122 to a signal compatible with the input requirements of a local controller or downstream algorithm. For example, raw turbidity measurement signals may be received at the converter stage 126 and converted to 4-20 mA signals corresponding to the total suspended solids ("TSS") for a given sample or relevant portion of the online composition.

The term "communications network" as used herein with respect to data communication between two or more system components or otherwise between communications network interfaces associated with two or more system components may refer to any one of, or a combination of any two or more of, telecommunications networks (whether wired, wireless, cellular or the like), a global network such as the Internet, local networks, network links, Internet Service Providers (ISP's), and intermediate communication interfaces. Any one or more conventionally recognized interface standards may be implemented therewith, including but not limited to Bluetooth, RF, Ethernet, and the like.

A processing and control stage 130 as represented in FIG. 1 may be provided with a hosted server 150 or network of hosted servers linked to the communications devices 132 as discussed above. The hosted server 150, which may be associated with a third party to the industrial plant or alternatively may be a server associated with the industrial plant or an administrator thereof, further may include or be linked to a data storage device or network 160 including models and/or algorithms relating to a process state and/or intervention event for, e.g., components or aspects of the production stage 110. A cloud-based server 150 implementation may accordingly be configured to process data provided from the industrial plant, in view of iteratively developed models residing in the data storage network 160, and to generate feedback to respective devices or user interfaces in the industrial plant relating to, e.g., Yankee dryer chemistry.

The above-referenced system 100 may be implemented in an embodiment of a method as further discussed below with illustrative reference to FIG. 2, and optionally further in an embodiment incorporating a method as further discussed below with illustrative reference to FIG. 3. Control functions for the methods may be described herein as being provided by, or otherwise implemented using, a processing and control stage 130 as shown in FIG. 1 and which may include a hosted cloud server 150, but various alternative embodiments including local or other controllers, as well as alternative and equivalent examples of algorithms or models, are contemplated within the scope of the present disclosure and the examples provided are non-limiting unless otherwise specifically noted. Depending on the embodiment, certain acts, events, or functions of any of the algorithms described herein can be performed in a different sequence, can be added, merged, or left out altogether (e.g., not all described acts or events are necessary for the practice of the algorithm) Moreover, in certain embodiments, acts or events can be performed concurrently, e.g., through multi-threaded processing, interrupt processing, or multiple processors or processor cores or on other parallel architectures, rather than sequentially.

One of skill in the art may appreciate that numerous steps in the process of implementing a Yankee dryer 112 for producing a creped product are conventionally known and generally dependent on the type of creped product or other selectable specifications, and detailed discussion of such steps or processes may be omitted herein as being generally outside of the scope of an invention as disclosed herein.

As represented in FIG. 2, online data collection 120 may include a first plurality of online sensors 122A to directly measure, sense, or otherwise obtain signals or values corresponding to a plurality of process components, including for example a blade vibration, crepe structure characteristics, Yankee boom chemistry, and the like. The online data collection stage 120 may further preferably include determination of a natural coating potential to be applied to the Yankee dryer 112, as further described in more detail below.

The outputs from the data collection stage 120 are transmitted via a communications network to a processing and control stage 130 which may include a remote (e.g., cloud-based) server network 150. In initial iterations of the method, a first server 150 may for example further transmit the outputs from the data collection stage 120 of the industrial plant to a separate server and/or data storage network 160 for iterative development and updating of predictive models associated with the present disclosure. Initial models may for example be constructed based on data collected and optionally aggregated from multiple production stages (e.g., chemical feed skids and Yankee dryer stage components) distributed across any number of industrial locations. Once the models have been sufficiently developed, subsequent inputs from the data collection stage 120 of a given industrial plant may be processed for predictive analysis 152 regarding quality characteristics of the creped product being produced.

Generally stated, the quality characteristics that may be determined by the system 100 as disclosed herein may include characteristics of the creped products that are not directly monitored in real time but are indirectly determinable using machine learning with respect to other process variables, such characteristics including for example softness, bulk, bulk to basis weight, and/or the like.

In various exemplary embodiments, intervention events may be identified via threshold-based analysis of an indirectly determined (or predicted) quality characteristic 152 with respect to a quality target 154 for the creped product. The quality target 154 may for example be selected or otherwise provided by a user associated with the production stage 110 via a user interface 128, or may be predetermined for a given type of product, and/or type of process, etc. Alternatively, or in addition, non-threshold-based analysis may be used to for example predict timing of an intervention event based on the indirectly determined quality characteristic(s). For example, the system may typically automatically implement regulation of one or more Yankee dryer chemistry components upon determining the presence of an intervention event, or may schedule such adjustments at a defined time in the future (or to be implemented in defined stages over time) based upon a predicted intervention event.

Various embodiments of these models may be deployed by the processing and control stage 130 (e.g., via the cloud server 150) to provide alerts to users to prompt them to manually inspect and regulate certain components as needed. The users may then be automatically prompted to provide feedback on the accuracy of the models, which would preferably be used to fine tune the models. In an embodiment, upon system prediction of an intervention event, a message may be generated to a user interface associated with an operator, administrator, representative, or the like for confirmation or approval to initiate automated regulation of an associated component in the production stage 110. Such approval may for example be received via user actuation of a dedicated button or other interface tool. Alternatively, and as otherwise noted in the present disclosure, an automated control procedure may be implemented dynamically upon determination of an intervention event, and without manual involvement.

Otherwise stated, implementing directly monitored values from the data collection stage 120 of the industrial plant, further in view of the models residing in the data storage network 160, intervention states may be indirectly predicted and/or determined for one or more quality characteristics of the creped product being manufactured. If one or more of the predicted and/or determined intervention states correspond to a determined intervention event (e.g., by comparing the quality characteristics with a received or determined quality target 154), the method may continue by providing feedback signals 160 to the industrial plant for actuating or triggering an automated control.

Certain embodiments of a method as disclosed herein may be fully automatic in implementation, without requiring or prompting human intervention via, e.g., the graphical user interface 128. The method may otherwise be selectively implemented for one or more intermediate steps wherein operators or other authorized personnel can approve or modify certain control adjustments. For example, the processing and control stage 130 and/or local controller may be configured to determine an amount and direction of adjustments to control valve positions in the production stage 110, and further generate a notification of the same to a designated user interface such as an operator dashboard, mobile app on a phone, etc. The authorized personnel may accordingly be prompted to enact the proposed interventions manually, or to provide feedback, via for example approval or edits to the recommended adjustment, wherein the server/controller resumes automated control of the one or more relevant system components based thereon.

Referring next to an embodiment as represented in FIG. 3, the system and method as previously described with respect to FIGS. 1 and 2 may include or optionally be modified to further include an exemplary method of regulating adhesive coating for a Yankee dryer 112 in real time by predicting a natural coating potential.

In the particular embodiment, one or more of the online sensors 122B are configured to provide measurements corresponding to stock/fibrous sheet characteristics comprising at least turbidity and conductivity. Conversion from the raw optical turbidity units to total suspended solids (TSS, mg/L) is linear and can be configured easily in the converter. Conversion from the raw conductivity measurements (as taken, e.g., in micro-siemens) to total dissolved solids (TDS, mg/L) is non-linear, and the manual determination of relationships according to conventional techniques requires a much longer test that involves evaporating water out of the sample. In one embodiment of the system as disclosed herein the converter 126, which may in various embodiments be linked to or alternatively integrated with a local controller, may implement predetermined correlations to convert raw values from, e.g., the conductivity sensor with a TDS value in real time and without requiring the manual sampling process, based on calculated coefficients, historical stored and retrieved results, or relationships alternatively extrapolated therefrom. In a particular embodiment, certain coefficients or relationships to be implemented for the conversion of turbidity units to TSS, and/or the conversion of conductivity to TDS, may be provided or updated manually from operators via the user interface, e.g., in the context of a respective product or furnish change.

In an embodiment, pH sensors may further be provided, as the pH value influences key parameters affecting the Yankee dryer coating and the quality of the final sheet. For example, one skilled in the art may appreciate that pH can impact wet end chemistries, drainage, charge and other conditions which in turn can affect post pressure roll consistency (dryness at the pressure roll nip) which will impact the Yankee dryer coating by increasing or decreasing the amount of rewetting caused by a wetter or a drier sheet adhering to the coating. pH and the impact on drainage can therefore be a critical factor in the coating performance and natural coating build up and subsequent adjustments necessary to maintain good crepe quality and softness.

In an embodiment, an additional one or more sensors 122B may detect real time values for one or more variables (such as temperature), so as to better correlate raw input values for, e.g., conductivity with converted values (e.g., TDS) based on predetermined relationships which may include or otherwise be influenced by associated factors (such as temperature).

Using the online data, or converted values therefrom, and further accounting for the machine speed and stock flow (as obtained, e.g., from one or more online sensors 122B) and the machine width (as obtained, e.g., from the operator interface 128), the processing and control stage 130 may be configured to make predictions on how the Yankee dryer surface properties will change in accordance with changes in the fiber source for the stock, such as for example from virgin to recycle, and among various other types or ratios thereof. The processing and control stage 130 in an embodiment may first calculate the potential for natural coating (NCP) 134 on the Yankee dryer 112 in accordance with the following exemplary equation:

$$\frac{(TSS+TDS)\text{mg}}{m^3} * \frac{(\text{Stock Flow})m^3}{\text{min}} * \frac{\text{min}}{(\text{machine speed})m} * \frac{1}{(\text{machine width})m} = NCP\frac{\text{mg}}{m^2}$$

The natural coating potential 134 as described above may be used as an input to the algorithm in FIG. 2 for determining or predicting quality characteristics of the creped product.

The processing and control stage 130 may then determine optimal coating feed rates 136, knowing for example what source of fiber is being used, along with the grade being produced and the machine speed. In an embodiment, the processing and control stage 130 may determine optimal settings for constituent components (e.g., individual chemical additives or combinations thereof having common effects) of the adhesive coating, such as for example adhesive aid components or release aid components. For example, where the coating application unit 118 may include a plurality of pumps associated with respective chemical additives for the synthetic coating mixture, the server may be configured to determine optimal settings or adjustments to one or more individual pumps or associated flow rates there through for the purpose of optimizing the total adhesive coating on the Yankee dryer 112 surface. In an embodiment, the server 150 may alternatively determine optimal settings for a general adhesive feed rate, independent of distinctions between the constituent components.

The processing and control stage 130 may generally be communicatively linked to a display unit 128, for example as may be positioned locally with respect to an operator control panel, remotely with respect to, e.g., a server-based and/or online dashboard, or both. The processing and control stage 130 may programmatically generate displayed values corresponding to any or all of the sensed values, the converted values corresponding to the TSS and/or TDS, the natural coating potential (NCP) and the optimal Yankee dryer surface coating feed rate(s). In an embodiment, the system may be provided with a manual mode, in which one or more operators are authorized to implement any desired changes in the feed rate set points for the coating application unit 118.

In an embodiment, the processing and control stage 130 may further be provided with an automatic mode 140, wherein the optimal feed rate value(s) may be compared with respective actual values or detected feed rate values, and control signals generated based thereon. In one example, a forward (open loop) control operation is enabled to identify and automatically implement a corrective action for one or more machine operating parameters, via regulation of the associated working implements, e.g., pumps in the adhesive coating application unit 118. The control operation may be proportional in nature, wherein the server identifies a directional aspect of the desired correction in order to obtain (or drive the system towards) an optimal adhesive coating, and the control operation may in certain embodiments further include an integral and/or derivative aspect wherein the corrective steps account for a rate of change over time to substantially prevent overshooting.

The system may enable the operators to selectively switch control of the coating feed rate from automatic mode to manual mode, such that the operators may use their judgment to made adjustments to the recommendations provided. In some embodiments, the system may be configured to prompt or otherwise provide alarms to operators via the user interface 128 to confirm that automatic mode is to be maintained. The system may provide such prompts or alarms in association with, e.g., predicted optimal values, corrective measures, or any other monitored trend in the operation that falls outside of defined thresholds for historical patterns.

In either of the manual or automatic operating modes, the processing and control stage 130 may generally be communicatively linked to the chemical pumps or local regulators or control actuators associated with the adhesive coating application unit 118 for the purpose of implementing manual or automatic adjustments to particular feed rate settings. Such links, as well as communication links with respect to at least the various sensors 122, the user interface 128, any local controllers, the historical data server storage 160, etc., may be provided via respective communications networks.

In an embodiment, a processing and control stage 130 as disclosed herein may include additional online measurement devices 142 for sensing actual adhesive coating characteristics with respect to the Yankee dryer surface. A feedback (closed loop) control 144 may further be implemented to account for one or more such characteristics, e.g., coating thickness, uniformity, composition, and the like.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an ASIC. The ASIC can reside in a user terminal. In the alternative, the processor and the medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A method of proactive process intervention in an industrial facility manufacturing creped products via a chemical feed stage and a Yankee dryer stage, wherein the chemical feed stage comprises a stock with one or more fiber sources from which a fibrous sheet is generated and transferred to engage a surface of the Yankee dryer, and wherein the Yankee dryer stage comprises an adhesive coating application unit and at least one blade configured to disengage the fibrous sheet from the surface of the Yankee dryer, the method comprising:

generating signals from a plurality of online sensors, the signals corresponding to directly measured variables for respective process components;

selectively retrieving information from computer-implemented models relating combinations of at least the directly measured variables to respective quality characteristics of at least the manufactured creped product;

indirectly predicting one or more quality characteristics in the manufactured creped product, substantially in real time with respect to the directly measured variables, based at least on one or more of the signals corresponding to directly measured variables; and automatically generating an output feedback signal corresponding to a detected intervention event based on the predicted one or more quality characteristics and respective predetermined targets, substantially in real time with respect to the directly measured variables and without waiting for direct quality measurements after completion of the creped product.

2. The method of claim 1, further comprising:

generating a value for total suspended solids associated with the stock flow based on a first predetermined correlation with one or more directly measured variables, generating a value for total dissolved solids associated with the stock flow based on a second predetermined correlation with one or more directly measured variables, and predicting a natural coating potential to be applied from the fibrous sheet to the surface of the Yankee dryer, substantially in real time, based at least in part on the generated values for total suspended solids and total dissolved solids, wherein the predicted one or more quality characteristics are further based at least on the predicted natural coating potential to be applied from the fibrous sheet to the Yankee dryer.

3. The method of claim 2, further comprising:

determining an optimal adhesive coating feed rate for projection upon the surface of the Yankee dryer, based at least in part on the predicted natural coating potential; and generating one or more feedback signals to the adhesive coating application unit to automatically regulate the adhesive coating feed rate based on a comparison of the determined optimal value with an actual adhesive coating feed rate.

4. The method of claim 2, wherein the directly measured variables for respective process components comprise directly measured vibrations of the blade, and the predicted one or more quality characteristics are further based at least on the vibrations of the blade.

5. The method of claim 1, wherein the predicted one or more quality characteristics comprises one or more of: a softness of the manufactured creped product; a crepe count per unit for the manufactured creped product; and a bulk to basis weight for the manufactured creped product.

6. The method of claim 1, wherein the detected intervention event is based on a threshold or range violation by at least one of the predicted one or more quality characteristics.

7. The method of claim 1, wherein the detected intervention event is based on a non-threshold violation with respect to a target control value for at least one of the predicted one or more quality characteristics.

8. The method of claim 1, wherein the output feedback signal is provided for automatic control of one or more actuators in the chemical feed stage for respective process components relating to the detected intervention event.

9. The method of claim 1, wherein the output feedback signal is provided to a display unit upon which is generated a prompt corresponding to the detected intervention event.

10. A system for proactive process intervention in an industrial facility manufacturing creped products via a chemical feed stage and a Yankee dryer stage, wherein the chemical feed stage comprises a stock with one or more fiber sources from which a fibrous sheet is generated and transferred to engage a surface of the Yankee dryer, and wherein the Yankee dryer stage comprises an adhesive coating application unit and at least one blade configured to disengage the fibrous sheet from the surface of the Yankee dryer, the system comprising:

a plurality of online sensors, each of the online sensors configured to produce signals corresponding to directly measured variables for respective process components;

one or more communications devices functionally linked to the plurality of online sensors and configured to generate messages to a remote server via a communications network, wherein the generated messages comprise data corresponding to the directly measured variables for each of the respective components;

the remote server comprising or functionally linked to a data storage further comprising computer-implemented models relating combinations of at least the directly measured variables to respective quality characteristics of at least the manufactured creped product;

the server further configured to automatically predict one or more quality characteristics in the manufactured creped product, substantially in real time with respect to the directly measured variables, based at least on one or more of the signals corresponding to directly measured variables by reference to at least one of the models; and automatically generate an output feedback signal corresponding to a detected intervention event based on the predicted one or more quality characteristics and respective predetermined targets, substantially in real time with respect to the directly measured variables and without waiting for direct quality measurements after completion of the creped product.

11. The system of claim 10, wherein the server is further configured to:

generate a value for total suspended solids associated with the stock flow based on a first predetermined correlation with one or more directly measured variables, generate a value for total dissolved solids associated with the stock flow based on a second predetermined correlation with one or more directly measured variables, and predict a natural coating potential to be applied from the fibrous sheet to the surface of the Yankee dryer, substantially in real time, based at least in part on the generated values for total suspended solids and total dissolved solids, wherein the predicted one or more quality characteristics are further based at least on the predicted natural coating potential to be applied from the fibrous sheet to the Yankee dryer.

12. The system of claim 11, wherein the server is further configured to:

determine an optimal adhesive coating feed rate for projection upon the surface of the Yankee dryer, based at least in part on the predicted natural coating potential; and generate one or more feedback signals to the adhesive coating application unit to automatically regulate the adhesive coating feed rate based on a comparison of the determined optimal value with an actual adhesive coating feed rate.

13. The system of claim 11, wherein the directly measured variables for respective process components comprise directly measured vibrations of the blade, and the predicted one or more quality characteristics are further based at least on the vibrations of the blade.

14. The system of claim 10, wherein the predicted one or more quality characteristics comprise one or more of: a softness of the manufactured creped product; a crepe count per unit for the manufactured creped product; and a bulk to basis weight for the manufactured creped product.

15. The system of claim 10, wherein the detected intervention event is based on a threshold or range violation by at least one of the predicted one or more quality characteristics.

16. The system of claim 10, wherein the detected intervention event is based on a non-threshold violation with respect to a target control value for at least one of the predicted one or more quality characteristics.

17. The system of claim 10, wherein the output feedback signal is provided for automatic control of one or more actuators in the chemical feed stage for respective process components relating to the detected intervention event.

18. The system of claim 10, wherein the output feedback signal is provided to a display unit upon which is generated a prompt corresponding to the detected intervention event.

* * * * *